US012049896B2

(12) United States Patent
Busch

(10) Patent No.: US 12,049,896 B2
(45) Date of Patent: Jul. 30, 2024

(54) BALANCING MECHANISM FOR SCROLL COMPRESSORS

(71) Applicant: OET GMBH, Lustenau (AT)

(72) Inventor: Christian Busch, Feldkirch (AT)

(73) Assignee: OET GmbH, Lustenau (AT)

( * ) Notice: Subject to any disclaimer, the term of this patent is extended or adjusted under 35 U.S.C. 154(b) by 0 days.

(21) Appl. No.: 18/041,292

(22) PCT Filed: Aug. 4, 2021

(86) PCT No.: PCT/EP2021/071739
§ 371 (c)(1),
(2) Date: Feb. 10, 2023

(87) PCT Pub. No.: WO2022/033934
PCT Pub. Date: Feb. 17, 2022

(65) Prior Publication Data

US 2023/0323880 A1 Oct. 12, 2023

(30) Foreign Application Priority Data

Aug. 14, 2020 (DE) ..... 10 2020 121 442.1

(51) Int. Cl.
*F04C 29/00* (2006.01)
*F04C 18/02* (2006.01)

(52) U.S. Cl.
CPC ..... *F04C 29/0021* (2013.01); *F04C 18/0215* (2013.01); *F04C 2240/807* (2013.01); *F04C 2270/125* (2013.01); *F04C 2270/135* (2013.01)

(58) Field of Classification Search
CPC ..... F04C 29/0021; F04C 18/0215; F04C 2240/807; F04C 2270/125; F04C 2270/135; F04C 2270/12
See application file for complete search history.

(56) References Cited

U.S. PATENT DOCUMENTS 4,824,346 A 4/1989 Hiraga et al.
4,898,520 A 2/1990 Nieter et al.
(Continued)

FOREIGN PATENT DOCUMENTS

DE 693 24 278 T2 7/1999
DE 10 2019 108 079 10/2019
(Continued)

OTHER PUBLICATIONS

Search Report issued in corresponding German Patent Application No. 10 2020 121 442.1, May 20, 2021, 8 pages.
(Continued)

*Primary Examiner* — J. Todd Newton
(74) *Attorney, Agent, or Firm* — HSML P.C.

(57) ABSTRACT

A balancing mechanism for a positive displacement machine, in particular a scroll compressor, wherein the balancing mechanism includes a drive shaft, a first balancing element and a second balancing element. The first balancing element includes a cylindrical hub section and a first force transmission section and is rotatably in contact with the drive shaft via a first axis of rotation. The second balancing element is rotatably in contact with the drive shaft via a second axis of rotation. A center axis S of the drive shaft and a center axis C of the cylindrical hub section are arranged on a first reference line CS, and a center of gravity J of the first balancing element and a center of gravity K of the second balancing element are arranged on a different side of the first reference line CS than a center axis P of the first axis of rotation.

14 Claims, 5 Drawing Sheets

(56) References Cited

U.S. PATENT DOCUMENTS

Figure 1:
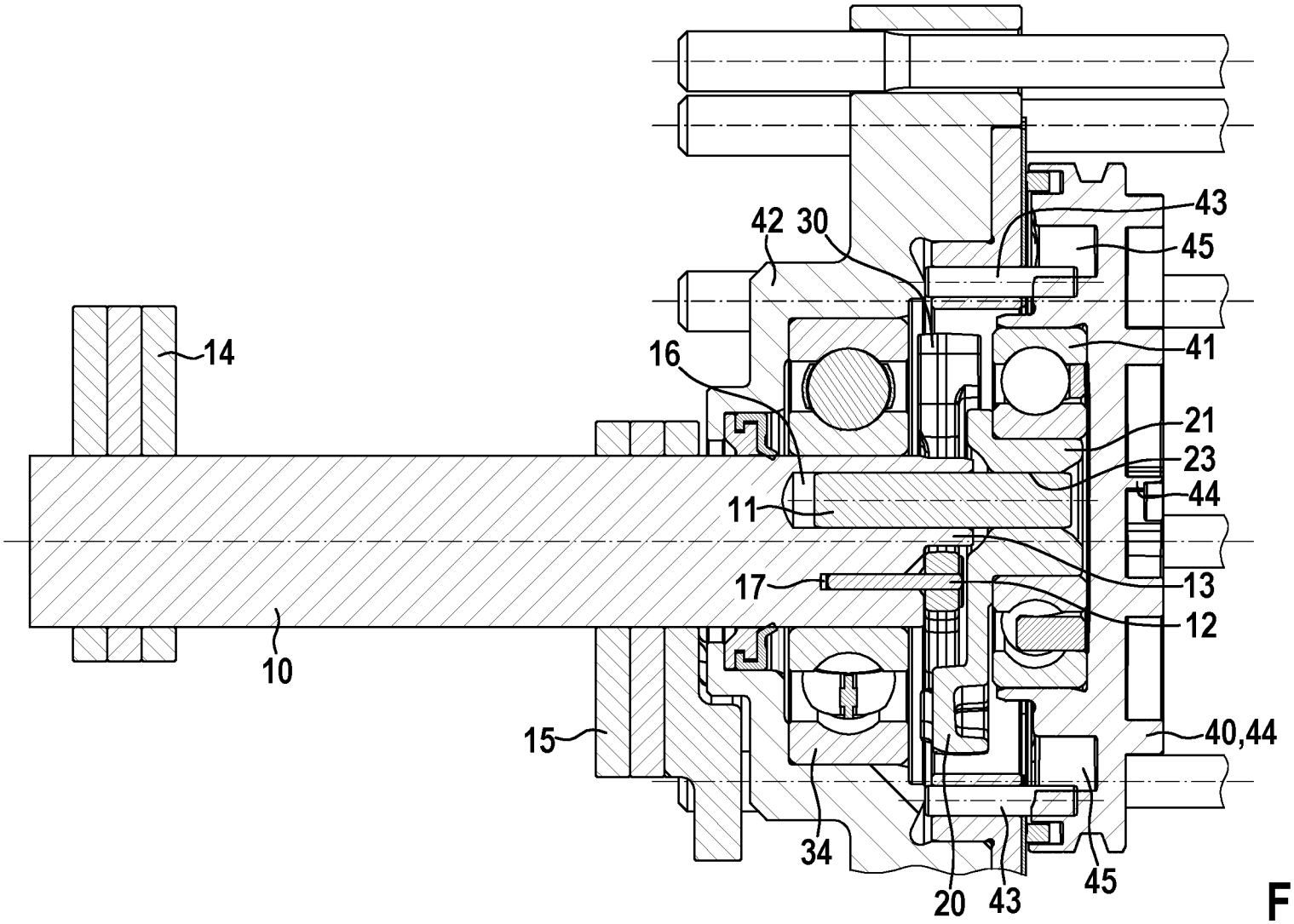

| | | | | |
|---|---|---|---|---|
| 5,454,019 | A | 9/1995 | Migita et al. | |
| 11,193,490 | B2 * | 12/2021 | Kuma | F04C 18/0215 |
| 11,661,940 | B2 * | 5/2023 | Lv | F01C 19/005 418/94 |
| 2008/0292484 | A1 | 11/2008 | Suh et al. | |
| 2015/0198161 | A1 * | 7/2015 | Tozawa | F04C 29/0057 418/55.3 |
| 2019/0063436 | A1 | 2/2019 | Takamura et al. | |
| 2019/0301464 | A1 * | 10/2019 | Kuma | F04C 29/0021 |
| 2020/0088198 | A1 * | 3/2020 | Moon | F04C 18/0207 |
| 2020/0332797 | A1 | 10/2020 | Hahn et al. | |
| 2021/0324857 | A1 * | 10/2021 | Kuma | F04C 29/0021 |
| 2023/0323880 | A1 * | 10/2023 | Busch | F04C 18/0215 418/55.1 |

FOREIGN PATENT DOCUMENTS

| | | |
|---|---|---|
| DE | 10 2019 213 919 | 3/2020 |
| JP | 04-265485 | 9/1992 |
| KR | 10-2006-0022098 | 3/2006 |

OTHER PUBLICATIONS

Office Action issued in corresponding German Patent Application No. 10 2020 121 442.1, Mar. 24, 2022, 6 pages.

Internationl Search Report and Written Opinion issued in International Application No. PCT/EP2021/071739, Nov. 18, 2021, 24 pages w/translation of ISR and JP 04-265485.

Notice of Reasons for Rejection issued in corresponding Japanese Patent Application No. 2023-510381, Mar. 13, 2024, 8 pages w/translation.

* cited by examiner

BALANCING MECHANISM FOR SCROLL COMPRESSORS

The invention relates to a balancing mechanism for a positive displacement machine according to the scroll principle, in particular scroll compressors, as well as a positive displacement machine according to the scroll principle with such a balancing mechanism.

Prior art scroll compressors are known which compress a fluid by guiding the fluid between two nested displacement spirals and compressing it therein. The scroll compressors comprise a fixed displacement spiral and a movable, in particular orbiting, displacement spiral, with a compression space being formed between the spiral walls, the volume of which changes as a result of the movement of the movable displacement spiral. This change in volume compresses the fluid conveyed therein.

For a good compaction function, it is important that the spiral walls of the fixed displacement spiral and the movable displacement spiral bounding the compaction space are in good sealing contact with each other. However, this sealing causes difficulties in practice. On the one hand, manufacturing tolerances can lead to leakage. On the other or additional hand, gas forces exerted by the compressing fluid on the two intermeshing displacement spirals must be taken into account. The gas forces can force the spiral walls of the two intermeshing displacement spirals apart, so that the compression chamber is no longer adequately sealed. This allows gas to escape from the compression chamber, reducing the gas forces and causing the spiral walls to come back into contact with each other. This interplay can lead to undesirable noise generation and, in particular, vibrations, which overall disrupt the operation and efficiency of the scroll compressor.

The movable displacement spiral is usually driven by a drive shaft, whereby the movable displacement spiral is mounted eccentrically on the drive shaft. A rotation of the drive shaft is thus converted into an orbiting movement of the movable displacement spiral. For this purpose, an axis of rotation is provided on the drive shaft, which is arranged off-center relative to the center axis of the drive shaft. The movable displacement spiral is mounted on the axis of rotation.

To reduce vibrations occurring due to gas forces and manufacturing tolerances and to improve tightness between the spiral walls, U.S. Pat. No. 4,824,346 A proposes a balancing mechanism. The known balancing mechanism includes a balancing mass eccentrically disposed on the axis of rotation of the movable displacement spiral and capable of oscillating about the axis of rotation. The oscillating movement, which is automatically adjusted on the basis of the centrifugal forces, compensates for the gas forces and also for manufacturing tolerances, so that the tightness of the compression space between the two displacement spirals and thus the efficiency of the scroll compressor are improved. A disadvantage of this known solution, however, is the relatively high balancing mass, which on the one hand comprises a high installation space requirement in the scroll compressor and on the other hand leads to an imbalance, which in particular in scroll compressors operated at different speeds can result in high noise generation due to vibrations occurring.

DE 10 2019 108 079 A1 counters these disadvantages by arranging the oscillating balancing element so that its center of gravity is located on the same side of a common center plane of the drive shaft and the movable displacement spiral as the center axis of gravity of the axis of rotation of the movable displacement spiral. In this way, additional moments occur at the balancing element during operation to compensate for manufacturing tolerances and gas forces. As a result, the balancing mass of the balancing element can be reduced, thereby reducing a requirement for installation space and the occurrence of vibrations at different speeds of the scroll compressor. However, it has been shown that there are also limits to this, particularly with regard to the minimum balancing mass that is still required to maintain a good effect of the balancing mechanism. In particular, scroll compressors that are operated over a wide speed range continue to experience noticeable vibrations.

Based on the aforementioned prior art, it is the task of the invention to provide a balancing mechanism for a positive displacement machine according to the scroll principle, in particular scroll compressors, which favors a further increase in the efficiency of positive displacement machines according to the scroll principle and further reduces the occurrence of vibrations. Furthermore, it is the task of the invention to specify a positive displacement machine according to the scroll principle, in particular scroll compressors, with such a balancing mechanism.

According to the invention, this task is solved with respect to the balancing mechanism by the subject-matter of patent claim 1 and with respect to the positive displacement machine by the subject-matter of patent claim 13.

Thus, the invention is specifically based on the idea of providing a balancing mechanism for a positive displacement machine according to the scroll principle, in particular scroll compressors, wherein the balancing mechanism comprises a drive shaft, a first balancing element and a second balancing element. The first balancing element comprises a cylindrical hub section and a first force transmission section and is rotatably in contact with the drive shaft via a first axis of rotation. The second balancing element is rotatably in contact with the drive shaft via a second axis of rotation. A center axis S of the drive shaft and a center axis C of the cylindrical hub section are arranged on a first reference line CS. A center of gravity J of the first balancing element and a center of gravity K of the second balancing element are arranged on another side of the first reference line CS than a center axis P of the first axis of rotation.

The first axis of rotation and the second axis of rotation are preferably each arranged eccentrically or off-center with respect to the center axis S of the drive shaft. The balancing elements can each be in contact with or connected to the drive shaft indirectly or directly or directly or indirectly via the axes of rotation assigned to them. The axes of rotation can thus each form connecting links that establish the connection between the respective balancing element and the drive shaft. However, it is not excluded that the connection via the axes of rotation is indirect, i.e. that further components participate in the connection or are arranged between the respective balancing element and the drive shaft.

With regard to the first balancing element, it is preferred if its hub section is in contact with or connected to the drive shaft via the first axis of rotation.

Thus, the invention utilizes a second balancing element that can also oscillate during operation of a positive displacement machine according to the scroll principle. In this way, further moments are generated which provide additional compensation for gas forces and manufacturing tolerances. By appropriate design of the compensation mass and the position of the corresponding centers of gravity, it is thus possible to adjust the compensation of gas forces and manufacturing tolerances much more finely. As a result, the balancing mechanism according to the invention results in improved running smoothness of a positive displacement machine according to the scroll principle, in particular also when the positive displacement machine is operated with high speed differences. This increases the efficiency of the positive displacement machine, since a seal is ensured between the displacement spirals of the positive displacement machine and thus the compression chamber over a wide speed band.

The drive shaft may comprise a first axis of rotation at the front end, on which a first balancing element comprising a cylindrical hub section and a first force transmission section is supported. The drive shaft may also comprise a second axis of rotation on which a second balancing element is mounted.

In a preferred embodiment of the invention, the hub section of the first balancing element comprises an eccentrically arranged fitting hole in which the first axis of rotation engages. Furthermore, the second balancing element may comprise an engagement hole in which the second axis of rotation engages. Preferably, there is some play between the fitting hole and the first axis of rotation and/or between the engagement hole and the second axis of rotation, respectively, to the extent that the hub section can oscillate about the first axis of rotation and the second balancing element can oscillate about the second axis of rotation. Thus, the connection between the first axis of rotation and the fitting hole and the connection between the second axis of rotation and the engagement hole is in each case positive, but not non-positive. Thus, a rotary plain bearing is essentially formed between the fitting hole and the first axis of rotation and between the engagement hole and the second axis of rotation.

Alternatively, it may be provided that the first axis of rotation is fixedly connected to the first balancing element and the second axis of rotation is fixedly connected to the second balancing element. In particular, the axes of rotation may each be monolithically formed with the associated balancing element. Thus, the balancing elements can each comprise a pin extension that forms the respective axis of rotation. The first axis of rotation, which can be arranged on the first balancing element, is preferably arranged eccentrically with respect to the hub section or its center axis and is firmly connected to the hub section or is monolithically formed therewith. In order to permit a rotational movement or pivoting movement of the balancing elements, it is preferably provided in this respect that the drive shaft comprises corresponding blind holes in which the axes of rotation engage. Thus, a first blind hole can be provided in which the first axis of rotation engages. A second blind hole can receive the second axis of rotation. Preferably, the axes of rotation are each rotatably mounted in the associated blind holes. In this respect, there is preferably a rotary plain bearing between the respective axis of rotation and the associated blind hole.

Overall, the first balancing element can be rotatably connected to the drive shaft via the first axis of rotation, wherein the first axis of rotation is either rotationally fixedly connected to the balancing element and the drive shaft or, conversely, rotationally fixedly connected to the drive shaft and the balancing element. Correspondingly, the second balancing element can be rotatably connected to the drive shaft via the second axis of rotation, wherein the second axis of rotation is either rotationally fixed to the balancing element and the drive shaft or, conversely, rotationally fixed to the drive shaft and the balancing element.

With regard to a compact design of the balancing mechanism, it is preferred if the second balancing element is arranged between the first balancing element and a scroll-side drive shaft bearing. In this case, individual sections of the first balancing element and the second balancing element can overlap in the longitudinal direction of the drive shaft, so that the overall size or overall height of the balancing mechanism is further reduced.

The first balancing element and/or the second balancing element are each preferably of one-piece or monolithic design.

The first balancing element comprises a first force transmission section. It may further be provided that the second balancing element comprises a mass section and a second force transmission section, the mass section and the second force transmission section being arranged on the same side of a second reference line PQ connecting the center axis P of the first axis of rotation and a center axis Q of the second axis of rotation.

In a preferred embodiment of the invention, the second force transmission section of the second balancing element is in force-transmitting abutment with the first force transmission section of the first balancing element. Thus, centrifugal force-induced deflections of the first balancing element are well transmitted to the second balancing element. This coupling of the balancing elements ensures particularly smooth running of the positive displacement machine.

The drive shaft can further comprise a spacer element that extends around the first axis of rotation and has a height that is greater than the thickness of the second balancing element in the area of the engagement hole. This ensures that the first balancing element and the second balancing element are each comprised at different heights and cannot block each other.

To limit oscillatory movement of the second balancing element, the first balancing element comprises a web rising toward the drive shaft to form an abutment for the mass section of the second balancing element.

A secondary aspect of the invention relates to a positive displacement machine according to the scroll principle, in particular scroll compressors, with a balancing mechanism described above.

In the positive displacement machine according to the invention, in a preferred variant, it is provided that the hub section carries a scroll bearing which is connected to a movable displacement spiral, in particular a displacement spiral which orbits during operation, the movable displacement spiral engaging a stationary displacement spiral.

Figure 2:
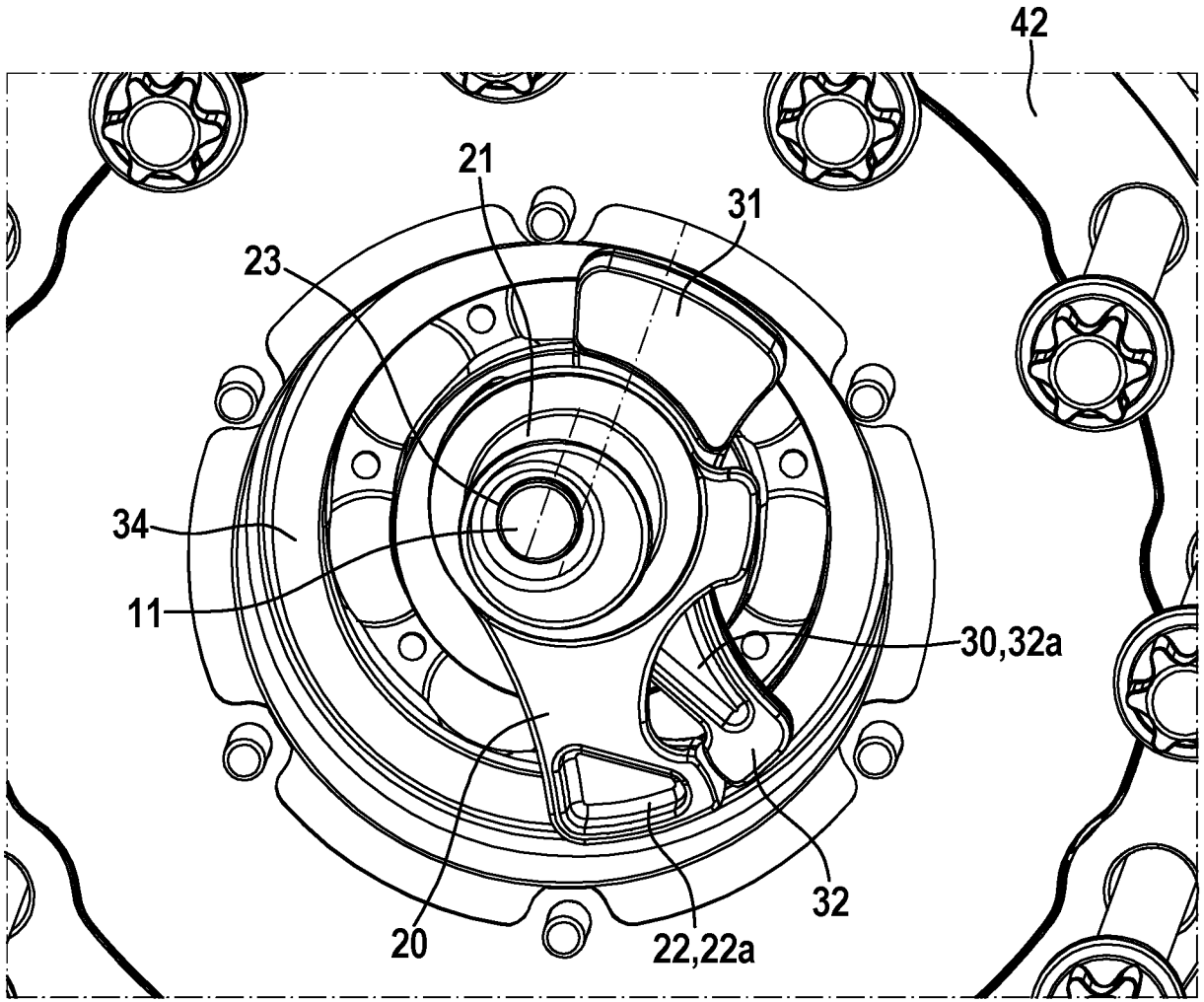
Figure 3:
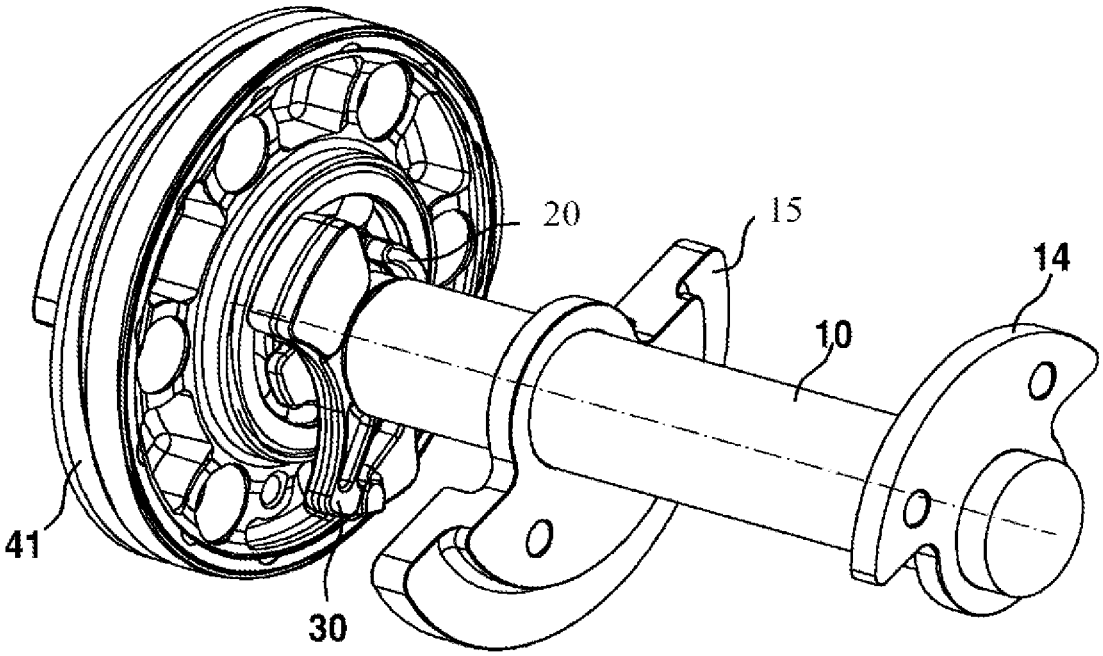
Figure 4:
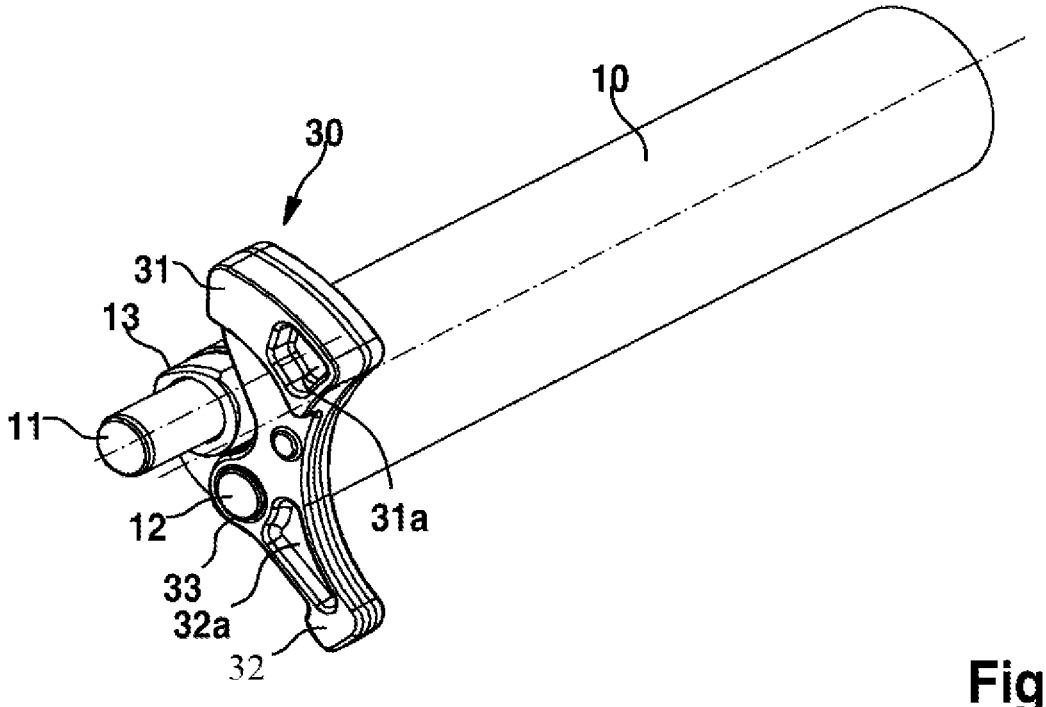
Figure 5:
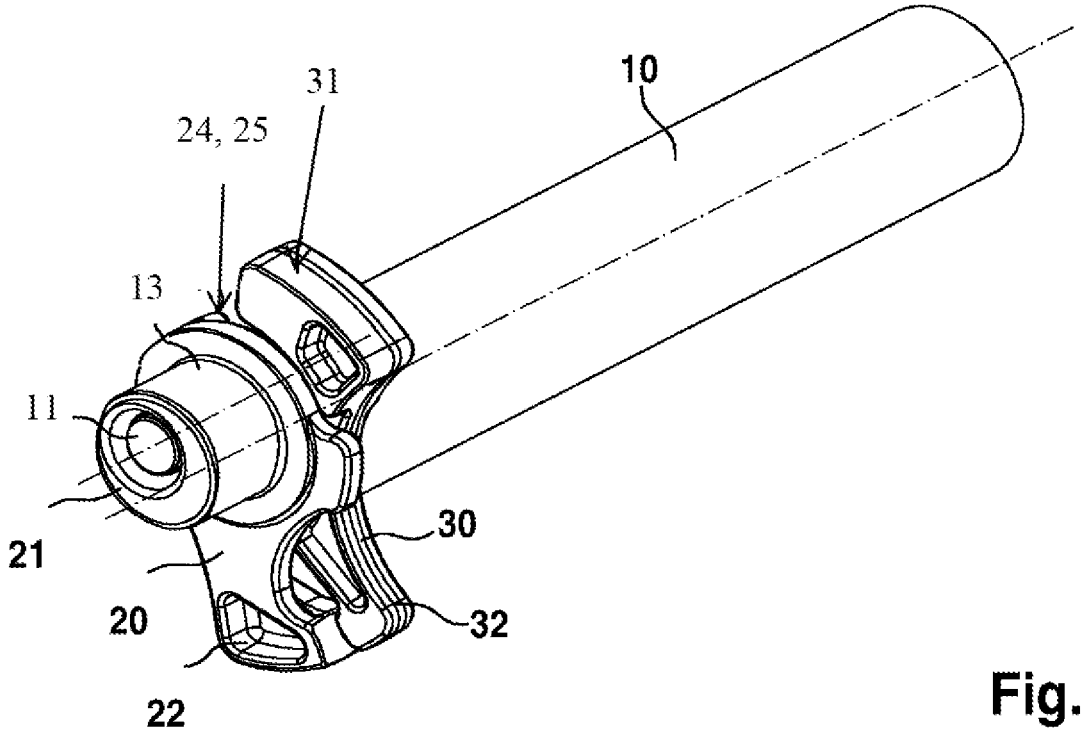
Figure 6:
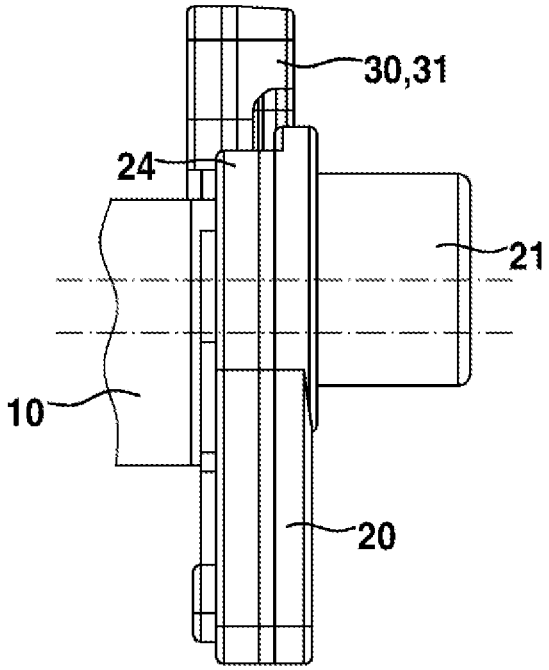

The invention is explained in more detail below by means of an example of an embodiment with reference to schematic drawings. Therein show FIG. 1 longitudinal section through a balancing mechanism according to the invention in the installed state within a positive displacement machine according to the scroll principle;

FIG. 2 perspective top view of the balancing mechanism according to FIG. 1 in the installed state;

FIG. 3 perspective side view of the balancing mechanism according to FIG. 1, additionally showing a scroll bearing of a movable displacement spiral of the positive displacement machine;

FIG. 4 perspective detail view of the balancing mechanism according to FIG. 1, wherein the first balancing element is hidden for improved visualization of the second balancing element;

FIG. 5 perspective view of the balancing mechanism according to FIG. 1 with both balancing elements;

FIG. 6 side view of the balancing mechanism according to FIG. 5; and

Figure 7:
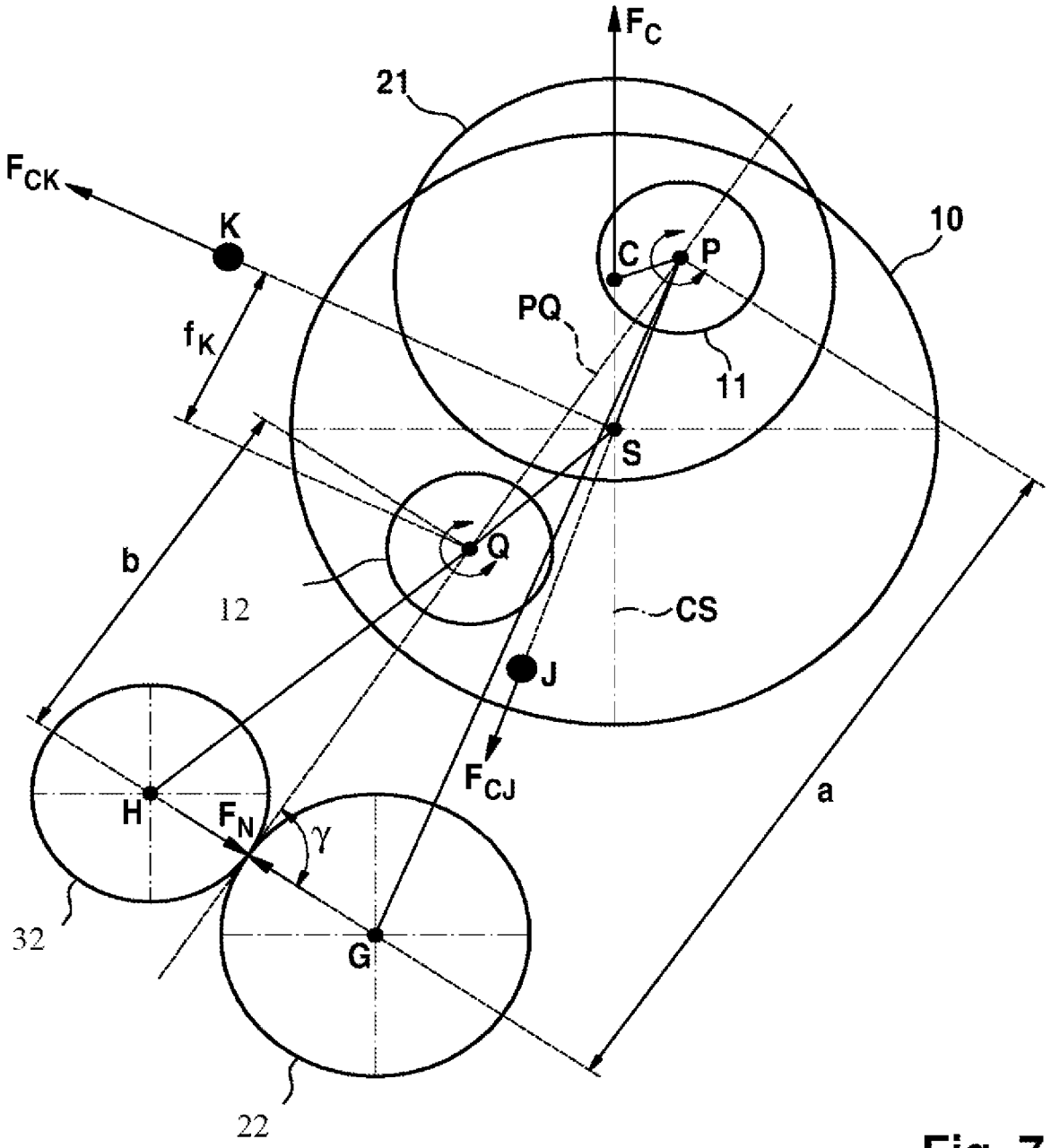

FIG. 7 geometric representation of the position of the center axes and centers of gravity of different components of the balancing mechanism according to FIG. 1, where forces that occur are also shown.

FIG. 1 shows a cross-sectional view of a balancing mechanism according to an embodiment according to the invention. The balancing mechanism comprises a drive shaft 10, which is mounted in a partition wall 42 of a compressor housing via a scroll-side drive shaft bearing 34. The drive shaft 10 is further supported at an opposite end also in a housing-side shaft bearing, which is not shown in FIG. 1 for clarity. The partition wall 42 is usually fixedly arranged in an outer housing of a positive displacement machine, preferably a positive displacement machine according to the scroll principle, in particular a scroll compressor. The partition wall 42 separates a compressor area from a drive area within the positive displacement machine. In the drive area, the majority of the drive shaft 10 is arranged, which is driven mechanically or, particularly preferably, electrically, in particular by an electric motor. The electric motor is preferably also arranged in the drive area.

In the drive area, the drive shaft 10 also comprises two counterweights 14, 15. Here, a first counterweight 14 is arranged at an end of the drive shaft 10 facing away from the compression area and is firmly connected to the drive shaft 10. A second counterweight 15 is arranged on a side of the drive shaft 10 facing the compaction area, in particular in the immediate vicinity of the partition wall 42. The second counterweight 15 is also firmly connected to the drive shaft 10. The counterweights 14, 15 thus rotate with the drive shaft 10 during operation and thus compensate for imbalances.

The drive shaft bearing 34 is held in the partition wall 42. In particular, the drive shaft bearing 34 can be press-fitted to the partition wall 42, which comprises a corresponding recess for this purpose. Furthermore, the drive shaft 10 may be press-fitted into the drive shaft bearing 34. The drive shaft bearing 34 is preferably designed as a ball bearing.

Two blind holes 16, 17 are provided at the end of the drive shaft 10 facing the compression area. A first blind hole 16 accommodates a first axis of rotation 11. A second blind hole 17 accommodates a second axis of rotation 12. The first blind hole 16 preferably comprises a larger cross-sectional diameter than the second blind hole 17. The axes of rotation 11, 12 are each pressed into their respective blind holes 16, 17. Thus, there is a non-positive, non-rotating connection between the respective axis of rotation 11, 12 and the associated blind hole 16, 17.

FIG. 1 also clearly shows that the blind holes 16, 17 or axes of rotation 11, 12 are arranged off-center with respect to a center axis of the drive shaft 10. Thus, the axes of rotation 11, 12 are not aligned coaxially with the drive shaft 10, but are offset substantially eccentrically with respect to the center axis of the drive shaft 10.

In addition, the drive shaft 10 comprises an extension in the region of the first axis of rotation 11, which forms a spacer element 13. The spacer element 13 is formed integrally with the drive shaft 10. In particular, the spacer element 13 may be formed as an annular projection. The blind hole 16 extends through the spacer element 13, preferably with a constant internal cross-sectional diameter along the entire length of the blind hole 16.

The second axis of rotation 12 projects beyond the longitudinal end of the drive shaft 10. However, the portion of the second axis of rotation 12 projecting beyond the second blind hole 17 includes a height that is preferably less than the height of the spacer element 13. The two axes of rotation 11, 12 each accommodate balancing elements 20, 30, which are described in more detail below.

A first balancing element 20 is arranged on the first axis of rotation 11. The first balancing element 20 is pivotally mounted on the first axis of rotation 11. Specifically, the first balancing element 20 comprises a hub section 21 that is substantially cylindrically shaped. The hub section 21 includes a fitting hole 23 in which the first axis of rotation 11 engages. A clearance exists between the first axis of rotation 11 and the fitting hole 23, such that the hub section 21 or the first balancing element 20 can generally rotate or pivot about the first axis of rotation 11. In this respect, there is substantially a sliding bearing between the fitting hole 23 and the first axis of rotation 11.

The hub section 21 extends into a scroll bearing 41. The hub section 21 is preferably press-fitted to the scroll bearing 41. The scroll bearing 41 is arranged in a scroll bearing seat of a movable displacement spiral 40. Preferably, the scroll bearing 41 is formed by a ball bearing. Preferably, the scroll bearing 41 is press-fitted to the movable displacement spiral 40.

The movable displacement spiral 40 is only partially shown in FIG. 1. In any case, it can be seen that the movable displacement spiral 40 comprises spiral walls 44, which are, however, only indicated in FIG. 1. Usually, the spiral walls 44 comprise a greater height than that shown schematically here. The spiral walls 44 engage in corresponding spiral walls of a fixed, in particular stationary, displacement spiral arranged opposite, which is also not shown in FIG. 1 for reasons of clarity.

The movable displacement spiral 40 is guided by guide pins 43 which are firmly connected to the housing of the compressor. The guide pins engage in corresponding guide spaces 45 of the movable displacement spiral 40 and prevent the movable displacement spiral 40 from rotating. Rather, the movable displacement spiral 40 is intended to orbit, i.e., to follow a predetermined, orbital path of motion.

FIG. 2 shows the balancing mechanism in a plan view. The direction of view in FIG. 2 is essentially from the compression chamber of the compressor toward the drive chamber of the compressor. In particular, the partition wall 42 into which the drive shaft bearing 34 is pressed can be seen. The balancing elements 20, 30 are arranged in a space in the partition wall 42 further above the drive shaft bearing 34. The first balancing element 20 comprises the hub section 21 in which the fitting hole 23 is formed. The fitting hole 23 is recognizably oriented off-center in the hub section 21. Thus, the center axis of the first axis of rotation 11 is not aligned with the center axis of the cylindrical hub section 21, but rather comprises a distance from the center axis of the hub section 21. Preferably, the hub section 21 comprises a height corresponding to the height of the portion of the first axis of rotation 11 projecting beyond the first blind hole 16.

The first balancing element 20 further comprises a first force transmission section 22 integrally connected to the hub section 21. The first force transmission section 22 comprises a first recess **22*a*. The first recess 22*a* has a substantially triangular shape, in particular a right-angled triangular shape. In this respect, the first recess 22*a* forms an area of reduced wall thickness of the first force transmission section 22, which serves to reduce the weight of the first force transmission section 22. The first force transmission section 22 comprises an overall substantially L-shape extending in the manner of a radially outwardly extending arm from the hub section 21. The first balancing element 20** is integrally formed as a whole.

A second force transmission section 32 is in contact with the first force transmission section 22 in the circumferential direction. The second force transmission section 32 is part of the second balancing element 30. The second balancing element 30 further comprises a mass section 31, which is spaced apart from the second force transmission section 32 in the circumferential direction of the drive shaft bearing 34. With respect to the second axis of rotation 12, the mass section 31 and the second force transmission section 32 are thus arranged at an obtuse angle to each other. The second balancing element 30 is also integrally formed as a whole.

It can also be seen in FIG. 2 that the second balancing element 30 is arranged in the longitudinal axial direction of the drive shaft 10 between the drive shaft bearing 34 and the first balancing element 20. However, at least in the force transmission sections 22, 32, there is an overlap in the longitudinal axial direction of the drive shaft 10, so that the force transmission sections 22, 32 of the two balancing elements 20, 30 can rest against each other. In this case, the force transmission sections 22, 32 abut one another in the circumferential direction or in the direction of rotation of the drive shaft 10. In the longitudinal axial direction of the drive shaft 10, there is preferably no contact between the balancing elements 20, 30. Rather, the balancing elements 20, 30 should be able to oscillate independently of one another about their respective axes of rotation 11, 12.

In FIG. 2, it can additionally be seen that the mass section 32 of the second balancing element 30 essentially forms a thickening that also overlaps the first balancing element 20 somewhat in the longitudinal axial direction. This enables space-saving installation of the second balancing element 20, while at the same time allowing the mass required for balancing imbalances to be used in the mass section 31.

The connecting arm to the second force transmission section 32 includes a second recess 32*a*, which also forms an area of reduced wall thickness of the second balancing element 30. In this way, material and thus mass is saved in the area of the second force transmission section 32, which provides for improved operation of the balancing mechanism.

FIG. 3 shows the balancing mechanism again in a perspective side view. In this, in particular, the design of the counterweights 14, 15 and their position and alignment on the drive shaft 10 can be clearly seen. The balancing elements 20, 30 are located at one longitudinal end of the drive shaft 10. Also shown is the scroll bearing 41, which adjoins the longitudinal end of the drive shaft 10 after the balancing elements 20, 30.

In the detail shown in FIG. 4, the design and position of the second balancing element 30 can be readily seen. The second balancing element 30 comprises an engagement hole 33, which is preferably formed as a through hole. The engagement hole 33 receives the second axis of rotation 12. Preferably, there is a clearance between the engagement hole 33 and the second axis of rotation 12 so that there is substantially a sliding bearing connection between the second axis of rotation 12 and the engagement hole 33. In this way, the second balancing element 30 can oscillate about the second axis of rotation 12.

A third recess 31*a* can also be seen in the region of the mass section 31. The third recess 31*a* reduces the material of the mass section 31 in areas, resulting in an improved mass distribution in the mass section 31. This mass distribution has been found to be particularly advantageous for reducing vibrations in a scroll compressor. In FIG. 4, it can also be seen that the spacer element 30 comprises a height that is greater than the thickness of the second balancing element 30 in the region of the extension of the drive shaft 10. This ensures that the first balancing element 20, which is seated on the first axis of rotation 11 and abuts the spacer element 13, maintains a distance from the second balancing element 30 in the longitudinal axial direction of the drive shaft 10.

In FIGS. 5 and 6, it can also be seen that the first balancing element 20 comprises a web 24 extending toward the drive shaft 10 in the longitudinal axial direction of the drive shaft 10. The web 24 is arranged on an outer side of the first balancing element 20 and extends substantially at a distance around the hub spacing 21 to the first force transmission section 22. The web 24 forms an abutment 25 in a region opposite the first force transmission section 22. The abutment 25 overlaps the mass section 31 of the second balancing element 30 in the longitudinally axial direction of the drive shaft 10, so that the mass section 31 can abut the abutment 25. Thus, relative vibration between the first balancing element 20 and the second balancing element 30 is limited. In essence, the second balancing element 30 can oscillate relative to the first balancing element 20 only in a range limited by the abutment 25 on the one hand and by the first force transmission section 22 on the other hand.

The position of the center axes and centers of gravity of different components of the balancing mechanism is of great importance for the smooth running of a positive displacement machine, in particular a scroll compressor, which is particularly advantageous in the invention. This particular arrangement of center axes or rotational axes and centers of gravity will be explained in more detail below on the basis of the geometric representation shown in FIG. 7.

In FIG. 7, the cross sections of the drive shaft 10, the first axis of rotation 11, the second axis of rotation 12 and the hub section 21 are shown by circles. Two further circles indicate the respective mass of the force transmission sections 22, 32.

The drive shaft 10 comprises a center axis S. The hub section 21 comprises a center axis C. It can be seen in FIG. 7 that the center axis C of the hub section 21 is arranged eccentrically to the center axis S of the drive shaft 10. The line connecting the center axes C, S of the drive shaft 10 and the hub section 21 is referred to as the first reference line CS.

The first axis of rotation 11 comprises a center axis P. The second axis of rotation 12 comprises a center axis Q. A second reference line PQ extends through the center axes P, Q of the axes of rotation 11, 12.

The first balancing element 20 comprises a center of gravity J, which is shown in FIG. 7. Also visible is the centrifugal force $F_{CJ}$ acting on the center of gravity J.

The second balancing element 30 comprises a center of gravity K, which is shown together with the centrifugal force $F_{CK}$ acting on it in FIG. 7. Looking at the first reference line CS, it can be seen that the center axis P of the first axis of rotation 11 is arranged on one side of the first reference line CS, whereas the centers of gravity J, K of the balancing elements 20, 30 are arranged on the other side of the first reference line CS. Thus, the arrangement differs substantially from the prior art according to DE 10 2019 108 079 A1, in which the center of gravity of a balancing element is arranged with its center axis of rotation on the same side of the first reference line, i.e., in the prior art, the center axis P and the center of gravity J are thus on the same side of the first reference line CS.

With reference to the second reference line PQ connecting the center axes of rotation 11, 12, it can be seen that the center of gravity K of the second balancing element 30 is arranged on one side of the second reference line PQ, whereas the center of gravity J of the first balancing element 20 is arranged on the other side of the second reference line PQ. However, the center axis of the hub section 21 of the first balancing element 20 is arranged on the same side as the center of gravity K of the second balancing element 30 with respect to the second reference line PQ. In contrast, the center axis S of the drive shaft 10 is located on the same side of the second reference line PQ as the center of gravity J of the first balancing element 20.

In other words, the center axes of the hub section 21 of the first balancing element 20 and the drive shaft 10 are located on different sides of the second reference line PQ. Similarly, the centers of gravity J, K of the balancing elements 20, 30 are on different sides of the second reference line PQ. The center axis S of the drive shaft 10 and the center of gravity J of the first balancing element 20 are located on one side of the second reference line PQ, whereas the center axis C of the hub section 21 and the center of gravity K of the second balancing element 30 are located on the other side of the second reference line PQ.

It can also be seen in FIG. 7 that the center of gravity K of the second balancing element 30 comprises a significantly greater distance from the second reference line PQ than the center of gravity J of the first balancing element 20. The same applies with respect to the first reference line CS. The center of gravity K of the second balancing element 30 comprises a greater distance to the first reference line CS than the center of gravity J of the first balancing element 20. This is preferably achieved by the mass section 31 and the force transmission section 32 of the second balancing element 30 being arranged on the same side of the second reference line PQ. Preferably, the mass section 31 and the second force transmission section 32 of the second balancing element 30 are aligned and arranged with respect to each other such that they are arranged entirely on one side of the second reference line PQ.

To illustrate that there is a mechanical interaction between the balancing elements 20, 30, FIG. 7 also shows the force FN that occurs when the force transmission sections 22, 32 are in contact. Thus, during operation of the balancing mechanism, the first force transmission section 22 transmits a force to the second force transmission section 32, which generates a corresponding counterforce. Preferably, the force transmission sections 22, 32 are formed such that the force and the counterforce balance each other out.

LIST OF REFERENCE SIGNS

10 drive shaft
11 first axis of rotation
12 second axis of rotation
13 spacer element
14 first counterweight
15 second counterweight
16 first blind hole
17 second blind hole
20 first balancing element
21 hub section
22 first force transmission section
22*a* first recess
23 fitting hole
24 web
25 abutment
30 second balancing element
31 mass section
31*a* third recess
32 second force transmission section
32*a* second recess
33 engagement hole
34 drive shaft bearing
40 movable displacement spiral
41 scroll bearing
42 partition wall
43 guide pin
44 spiral wall
45 guide space

The invention claimed is:

1. A balancing mechanism for a scroll compressor, wherein the balancing mechanism comprises a drive shaft, a first balancing element and a second balancing element, wherein the first balancing element comprises a cylindrical hub section and a first force transmission section and is rotatably in contact with the drive shaft via a first axis of rotation, and the second balancing element is rotatably in contact with the drive shaft via a second axis of rotation, and wherein a center axis S of the drive shaft and a center axis C of the cylindrical hub section are arranged on a first reference line CS, and wherein a center of gravity T of the first balancing element and a center of gravity K of the second balancing element are arranged on another side of the first reference line CS than a center axis P of the first axis of rotation.

2. The balancing mechanism according to claim 1, wherein the hub section comprises an eccentrically arranged fitting hole in which the first axis of rotation engages.

3. The balancing mechanism according to claim 1, wherein the second balancing element comprises an engagement hole in which the second axis of rotation engages.

4. The balancing mechanism according to claim 1, wherein the first axis of rotation is fixedly, in particular monolithically, and eccentrically connected to the hub section and is rotatably mounted in a first blind hole of the drive shaft.

5. The balancing mechanism according to claim 1, wherein the second axis of rotation is fixedly, in particular monolithically, connected to the second balancing element and is rotatably mounted in a second blind hole of the drive shaft.

6. The balancing mechanism according to claim 1, wherein the second balancing element is arranged between the first balancing element and a drive shaft bearing.

7. The balancing mechanism according to claim 1, wherein the first balancing element comprises a first force transmission section.

8. The balancing mechanism according to claim 1, wherein the second balancing element comprises a mass section and a second force transmission section arranged on the same side of a second reference line PQ connecting the center axis P of the first axis of rotation and a center axis Q of the second axis of rotation.

9. The balancing mechanism according to claim 8, wherein the second force transmission section of the second balancing element is in force-transmitting contact with the first force transmission section of the first balancing element.

10. The balancing mechanism according to claim 1, wherein the first balancing element and the second balancing element are each formed in one piece, in particular monolithically.

11. The balancing mechanism according to claim 1, wherein the drive shaft comprises a spacer element extending around the first axis of rotation and having a height greater than the thickness of the second balancing element in the region of the engagement hole.

12. The balancing mechanism according to claim 8, wherein the first balancing element comprises a web rising towards the drive shaft and forming a stop for the mass section of the second balancing element.

13. A scroll compressor, with a balancing mechanism according to claim 1.

14. The scroll compressor according to claim 13, wherein the hub section carries a scroll bearing which is connected to a movable displacement spiral, in particular a displacement spiral which orbits during operation, the movable displacement spiral engaging a stationary displacement spiral.

* * * * *